US010392822B2

(12) United States Patent
Thorpe

(10) Patent No.: US 10,392,822 B2
(45) Date of Patent: Aug. 27, 2019

(54) BIRTHING POOL

(71) Applicant: Better Products, Inc., Ellensburg, WA (US)

(72) Inventor: Debra Nelson Thorpe, Ellensburg, WA (US)

(73) Assignee: Better Products, Inc., Ellensburg, WA (US)

( * ) Notice: Subject to any disclaimer, the term of this patent is extended or adjusted under 35 U.S.C. 154(b) by 0 days.

(21) Appl. No.: 15/824,866

(22) Filed: Nov. 28, 2017

(65) Prior Publication Data

US 2019/0161985 A1 May 30, 2019

(51) Int. Cl.
*E04H 4/00* (2006.01)
*E04H 4/10* (2006.01)

(52) U.S. Cl.
CPC ..... *E04H 4/0025* (2013.01); *E04H 4/10* (2013.01)

(58) Field of Classification Search
CPC ... E04H 4/0025; E04H 4/0018; A47C 27/081; A47C 27/05769; A47C 4/54; A61G 7/05769
USPC ..... 4/513, 580–585, 588; 5/602, 706, 711
See application file for complete search history.

(56) References Cited

U.S. PATENT DOCUMENTS 1,738,411 A * 12/1929 Welch ..... A47C 27/081 482/27
2,433,012 A * 12/1947 Zalicovitz ..... A47C 27/05 267/142
2,887,692 A * 5/1959 Gosman ..... A47C 27/081 297/DIG. 3
3,631,544 A * 1/1972 Tytel ..... E04H 4/0025 206/522
D252,042 S 6/1979 Jacuzzi et al.
4,292,702 A * 10/1981 Phillips ..... A47C 27/081 137/574
4,651,360 A 3/1987 Wang
D318,895 S * 8/1991 Kuan ..... D21/816
5,729,840 A * 3/1998 Wu ..... E04H 4/0025 114/345
D404,457 S 1/1999 Peterson
D408,546 S 4/1999 Carreau
D409,707 S * 5/1999 Peterson ..... D21/815
(Continued)

FOREIGN PATENT DOCUMENTS

CN 301398132 S 12/2010
GB 2432116 B 5/2008
(Continued)

OTHER PUBLICATIONS

"Birth Pool in a Box Eco," © 1995-2010, Waterbirth International, <http://www.waterbirth.org/birth-pool-in-a-box> [retrieved May 9, 2016], 4 pages.

(Continued)

*Primary Examiner* — Erin Deery
(74) *Attorney, Agent, or Firm* — Christensen O'Connor Johnson Kindness PLLC

(57) ABSTRACT

A birthing pool (10) includes an inflatable floor (12) consisting of a bottom layer (16) and a top layer (18) spaced apart from each other by a series of longitudinal floor beams (20). A separate inflatable perimeter wall (14) is composed of an outer layer (30) and an inner layer (32) spaced apart from each other by upright wall beams (34) that define a serpentine profile along the height of the perimeter wall.

17 Claims, 7 Drawing Sheets

(56) References Cited

U.S. PATENT DOCUMENTS

| | | | | |
|---|---|---|---|---|
| 5,924,144 | A * | 7/1999 | Peterson | E04H 4/10 4/488 |
| 5,987,661 | A * | 11/1999 | Peterson | E04H 4/10 4/488 |
| D425,165 | S | 5/2000 | Klimenko | |
| 6,112,930 | A * | 9/2000 | McAtarian | F16N 31/006 220/9.1 |
| 6,408,453 | B1 * | 6/2002 | Song | E04H 4/0025 4/499 |
| D554,729 | S | 11/2007 | Peterson | |
| D725,210 | S | 3/2015 | Anastasia | |
| D741,436 | S * | 10/2015 | Lin | D21/815 |
| 9,254,240 | B2 | 2/2016 | Lin et al. | |
| 2009/0085393 | A1 * | 4/2009 | Austen | A47C 4/54 297/452.41 |
| 2009/0178191 | A1 * | 7/2009 | MacLean | A61G 13/0009 4/506 |
| 2014/0059760 | A1 | 3/2014 | Hendrick | |
| 2015/0020306 | A1 * | 1/2015 | Lin | A61H 33/028 4/585 |

FOREIGN PATENT DOCUMENTS

| | | | |
|---|---|---|---|
| GB | 2484478 | A | 4/2012 |
| WO | 2001/027414 | A1 | 4/2001 |

OTHER PUBLICATIONS

"Dimensions—Birth Pool in a Box," © 2016, Cascade Healthcare Products, <https://www.1cascade.com/dimensions-birth-pool-in-a-box> [retrieved May 9, 2016], 5 pages.

"Dreamer zms2158 Pool Large Inflatable Swimming Pool," China Senior Supplier, n.d., <http://www.chinaseniorsupplier.com/Sports_Entertainment/Water_Sports/672515607/New_design_PVC_inflatable_pool_air_pool_for floating.html> [retrieved May 9, 2016], 4 pages.

* cited by examiner

BIRTHING POOL

BACKGROUND

The present invention pertains to birthing pools, and in particular portable, inflatable birthing pools.

The use of birthing pools has become more common, especially in recent years as the benefits of water birthing have become better understood. Such benefits include a more relaxed and less painful labor, which is a result of the mother being able to assume a more comfortable position, as well as the increase in buoyancy of the body when in the water. Also, the warmth of the water may produce a sedative effect leading to more relaxation. As a result, at least during the first stages of labor, often reduced or no anesthesia is required.

In addition, water birth is thought to provide support for the birthing mother's perineum, leading to lower risk of tissue tearing and reduced need for the use of epidurals. As a result, water immersion could lead to a reduction in the length of the first stage of labor.

Hospitals now commonly provide permanently installed birthing pools. With the increased number of home births occurring, portable pools have been developed. Such portable pools may be of rigid or inflatable construction. An obvious advantage of an inflatable pool is that of portability and ease of storage. Drawbacks of current inflatable pools include the need for wide sidewall thicknesses to safely contain the volume of water in the pool, which can exceed at least 150 gallons. Also, inflatable pools are commonly circular in shape, thereby requiring significant floor space. In addition, with existing birthing pools, if a puncture occurs oftentimes the pool does not have sufficient structural integrity to contain the water therein. These issues are sought to be addressed by the birthing pool of the present disclosure.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A portable birthing pool comprises an inflatable substantially hollow floor section composed of a bottom layer and a top layer, with the top layer spaced above the bottom layer when the floor section is inflated. A plurality of floor beams or webs extend transversely between the top and bottom layers to divide the floor section into a plurality of side-by-side elongated chambers.

The birthing pool also includes an inflatable substantially hollow perimeter wall extending upwardly from the perimeter of the floor section. The perimeter wall includes an outer layer and an inner layer spaced inwardly from the outer layer when the perimeter wall is inflated. A plurality of upright wall beams or webs extend transversely between the outer layer and the inner layer of the perimeter wall to divide the perimeter wall into a series of upright side-by-side chambers. Further, each of the wall beams defines a serpentine profile along the length (height) of the wall beams.

In the birthing pool, the floor beams extend along the floor but stop short of the perimeter of the floor to define a fluid passage between adjacent floor chambers. The floor beams are substantially straight along their length and have side edges that are heat fused and/or glued or otherwise securely adhered to the top and bottom layers of the floor section.

In the birthing pool, the wall beams stop short of the bottom and top of the perimeter of the wall to define the fluid passageway between the chambers on opposite sides of the wall beam. In addition, the wall beam defines side edges that are securely attached by heat fusing, and/or gluing or by other means to the outer and inner layers of the perimeter wall.

A transversely rounded upper edge extends along the top of the perimeter wall and a transversely rounded lower edge extends along the bottom of the perimeter wall.

The inflatable birthing pool also includes a liner which is insertable into the interior of the pool and extends over the upper edge of the pool and skirts down the exterior of the birthing pool. The liner skirt snugly overlies the exterior of the birthing pool.

The birthing pool also includes a cover which is positionable over the birthing pool to assist in maintaining the temperature within the birthing pool. The cover has a skirt section that extends downwardly from the upper edge of the birthing pool to overlap the out layer of the perimeter wall.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
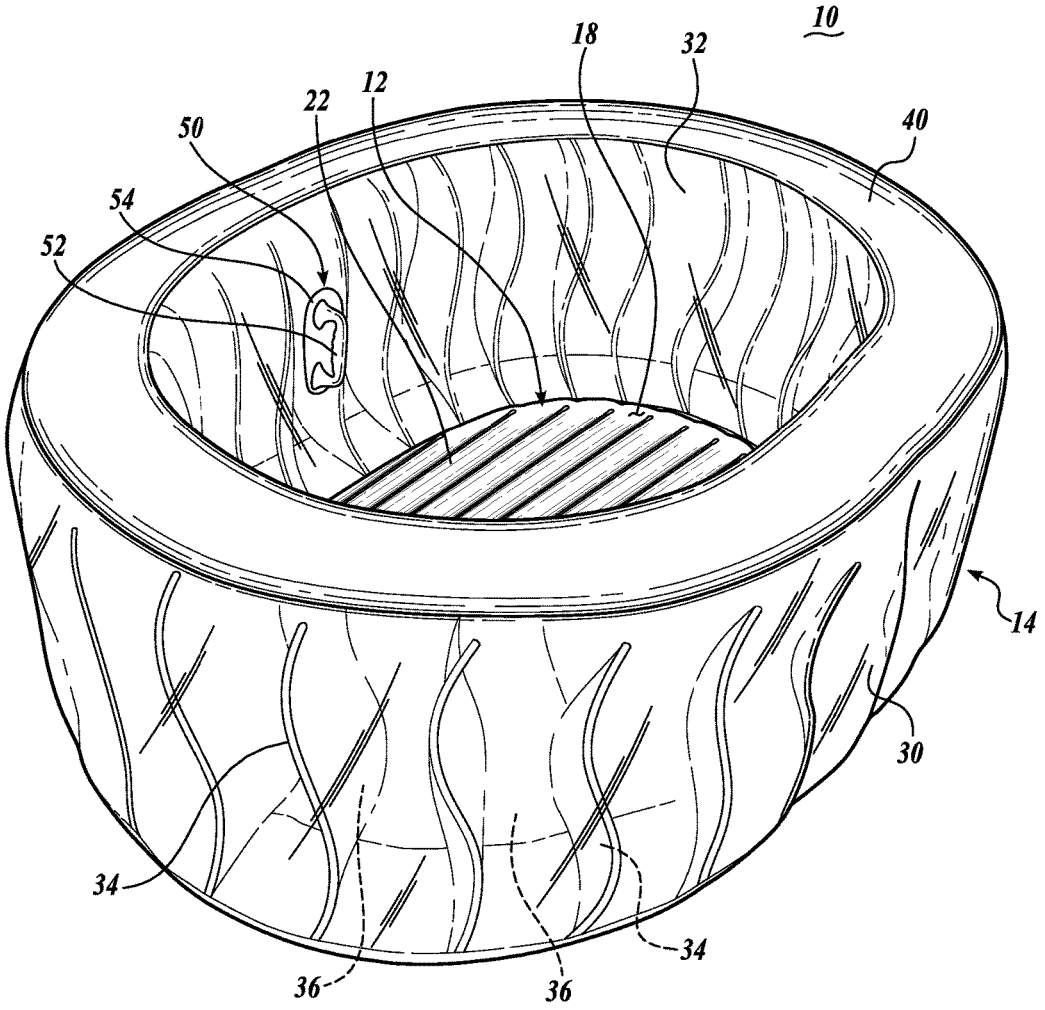
FIG. 1 is a top isometric view of an embodiment of the birthing pool of the present disclosure.
Figure 2:
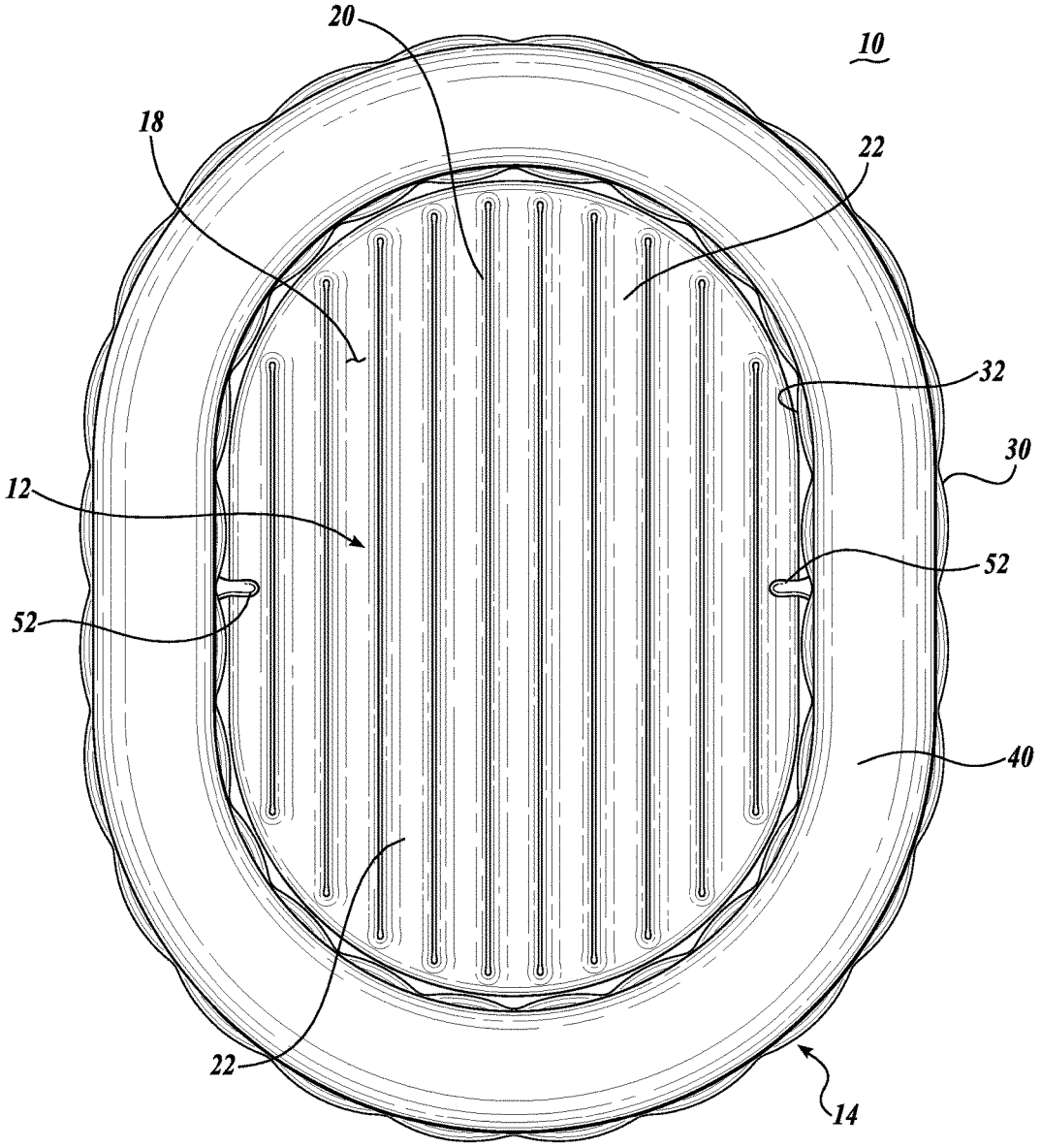
FIG. 2 is a top view of FIG. 1.

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. In some instances, well known process steps have not been described in detail in order not to unnecessarily obscure various aspects of the present disclosure. Further, it will be appreciated that embodiments of the present disclosure may employ any combination of features described herein.

The present application may include references to "directions," such as "forward," "rearward," "front," "back,"

"upward," "downward," "right hand," "left hand," "in," "out," "extended," "advanced," "retracted," "proximal," "distal," "above," "below," in front of," "behind," "on top of," and "beneath." These references and other similar references with respect to direction, position, location, etc., in the present application are only to assist in helping describe and understand the present invention and are not intended to limit the present invention to these directions, positions, locations, etc.

The present application may include modifiers such as the words "generally" or "substantially." These terms are meant to serve as modifiers to indicate that the "dimension," "shape," or other physical parameter, in question need not be exact, but may vary as long as the function that is required to be performed can be carried out. For example, in the phrase "generally circular in shape," the shape need not be exactly circular as long as the required function of the structure in question can be carried out.

In the following description, various embodiments of the present disclosure are described. In the following description and in the accompanying drawings, the corresponding systems assemblies, apparatus and units may be identified by the same part number, but with an alpha suffix. The descriptions of the parts/components of such systems assemblies, apparatus, and units are the same or similar are not repeated so as to avoid redundancy in the present application.

Referring to the drawings, the present disclosure pertains to an inflatable birthing pool 10, which is inflatable for use and then collapsible to a compact storage or transport configuration. The pool 10 is composed of an inflatable floor section 12 and separately inflatable perimeter wall 14 rising upwardly from the floor section. The birthing pool 10 is in an oval or ovoid shape as shown in the drawings.

Describing the pool 10 in more detail, the inflatable floor 12 consists of a bottom layer 16 and a top layer 18 which is spaced above the bottom layer when the floor is inflated. A series of longitudinal floor beams 20 extend lengthwise of the floor 12 and are positioned in space parallel relationship to each other. The edges of the floor beams 20 are fused or otherwise securely attached to the interior surfaces of the floor bottom and top layers 16 and 18 thereby to limit the separation between the top and bottom layers of the inflated floor and also divide the floor into separate floor chambers or compartments 22. As seen in the drawings, when the floor is inflated, the chambers or compartments bulge somewhat outwardly from the floor.

The ends of the floor beams 20 do not extend all the way to the perimeter of the floor section 12, but rather stop somewhat short of the floor perimeter. This enables the floor chambers 22 to be in fluid flow communication with each other with inflation fluid (air) passing from chamber to chamber between the ends of the floor beams and the perimeter of the floor structure. As such, the entire floor section 12 can be inflated by a single air inlet valve at one location at the floor section.

Of course, if desired, one or more of the floor I-beams 20 could extend all the way to the perimeter of the floor section thereby to divide the floor section into separate sets of chambers or compartments. One advantage of this construction would be that if a puncture occurs in a particular floor section, the entire floor section may not become deflated.

As noted above, the edges of the floor beams 20 are fused or otherwise attached to the top and bottom layers 18 and 16 of the floor section. Such fusion or attachment can be by heat fusion, gluing, or both, or by other techniques.

Further, although the floor beams 20 are shown as disposed edgewise or transversely to the plane of the floor section 12, the floor beams can be of other configurations or orientations. For example, the floor beams could extend edgewise diagonally to the floor section. In this regard, if the floor is viewed in cross section transversely to the floor section, the floor beams may be in the shape of a saw tooth or zigzag pattern across the width of the floor section. This would enable a continuous width of floor section material to be utilized. Of course, other configurations of the floor beams 20 may be employed.

As noted above, the perimeter wall 14 extends upwardly from the perimeter of the floor section 12. In a manner somewhat similar to the construction of the floor section 12, the perimeter wall 14 includes an outer layer 30 and an inner layer 32 spaced inwardly from the outer layer when the perimeter wall is inflated. Also in a manner similar to the construction of the floor section 12, upright wall beams 34 extend transversely across the width of the interior of the wall from the outer layer to the inner layer, thereby to divide the perimeter wall into a series of upright chambers or compartments 36.

However, rather than being substantially straight along its length (height), in the manner of floor beams 20, the wall beams 34 define a serpentine or S-shaped profile along the height of the perimeter wall 14. The edges of the wall beams 34 are fused or otherwise attached to the inside surfaces of the outer layer 30 and inner layer 32 of the perimeter wall thereby limiting the separation of the layers 30 and 32 which limits the thickness of the perimeter wall.

As with the floor beams, the edges of the wall beams 34 can be heat fused and/or glued or otherwise attached to the inside surfaces of the outer and inner layers 30 and 32 of the perimeter wall 14.

Also, the upper and lower ends of the wall beams 34 may not extend all the way to the top and bottom of the perimeter wall 14 so that the wall chambers 36 are in communication with each other. Air can pass between the upper and lower ends of the wall beams 34 and the top and bottom edges of the wall interior. As a consequence, it is possible to inflate the entire perimeter wall from one inlet valve thereby to complete the inflation as quickly as possible.

Of course, it is possible to construct the perimeter wall 14 so that one or more of the wall beams 34 extends all the way to the top of the perimeter wall as well as all the way to the bottom of the perimeter wall thereby to divide the perimeter wall into wall chamber sections, so that if one section of the perimeter wall were to become deflated, the remaining sections would not.

As can be appreciated, the wall beams 34, being of a serpentine or S-shape, result in a high structural integrity so that the width or thickness of the perimeter wall does not have to be exceedingly wide. Rather, the perimeter wall is relatively narrow or thin in comparison to the height of the wall. This enables the user to more conveniently step into or out of the pool 10 than if the construction of the perimeter wall 14 was such that the perimeter wall was required to be relatively wider than in the present construction.

Also, it will be appreciated that by use of the S-shaped wall beams 34, even if the wall 14 were to be punctured, the wall would tend to maintain its shape and thus retain the water therein rather than collapsing.

Although the wall beams 34 are in a serpentine or S-profile along their height, it will be appreciated that other shapes can be employed. For example, the wall beams can be of a saw tooth or zigzag profile along the height of the wall beams.

As most clearly shown in FIGS. 1-4, the upper edge 40 of the wall 14 is rounded so as to present a smooth transition from the upper edges of the inner and outer layers 32 and 30 of the wall 14. The upper edges of the inner and outer layers can be heat fused and/or glued or otherwise attached to the inner and outer perimeter of the wall upper edge 40.

Figure 3:
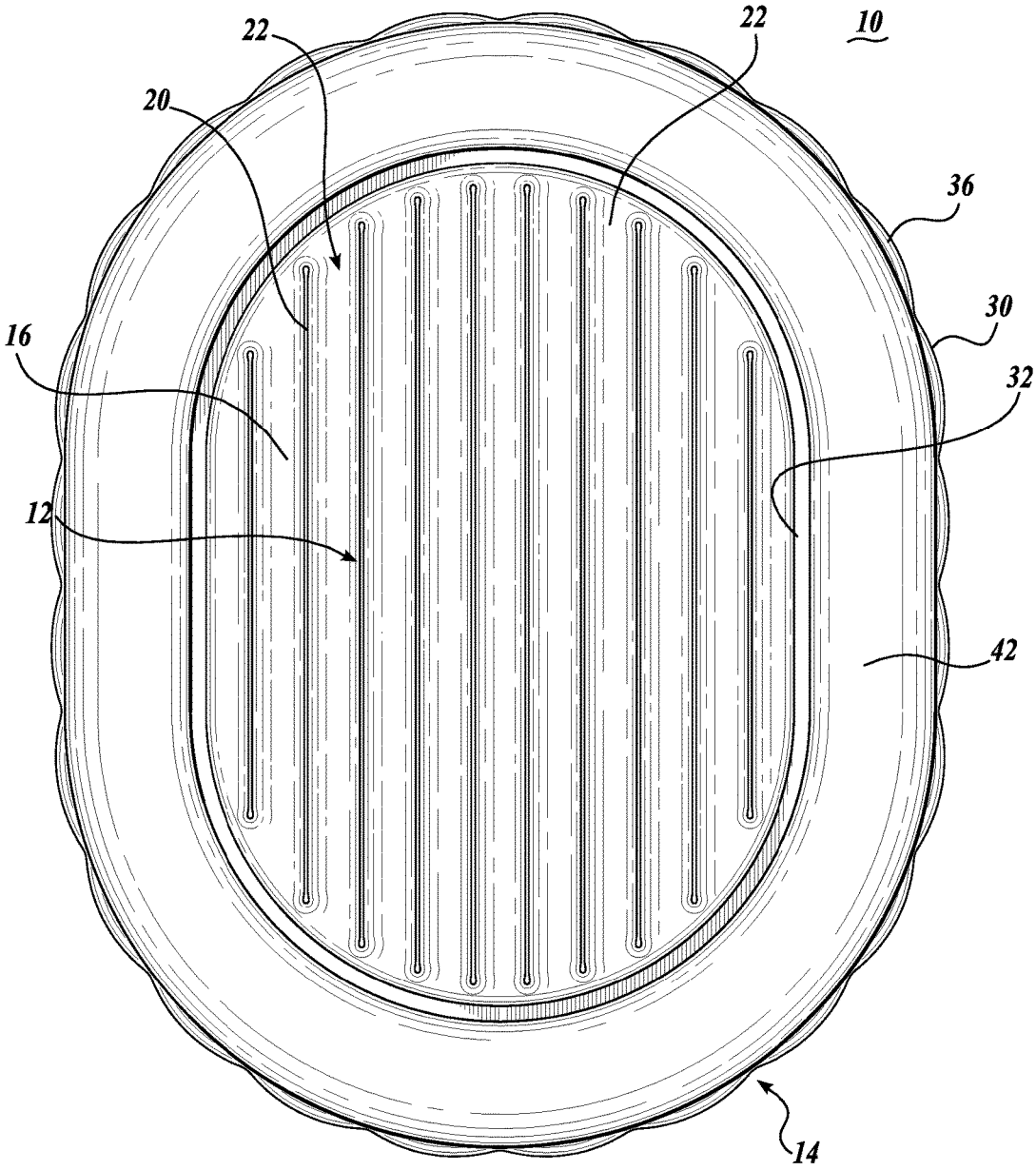
FIG. 3 is a bottom view of FIG. 1.
Figure 4:
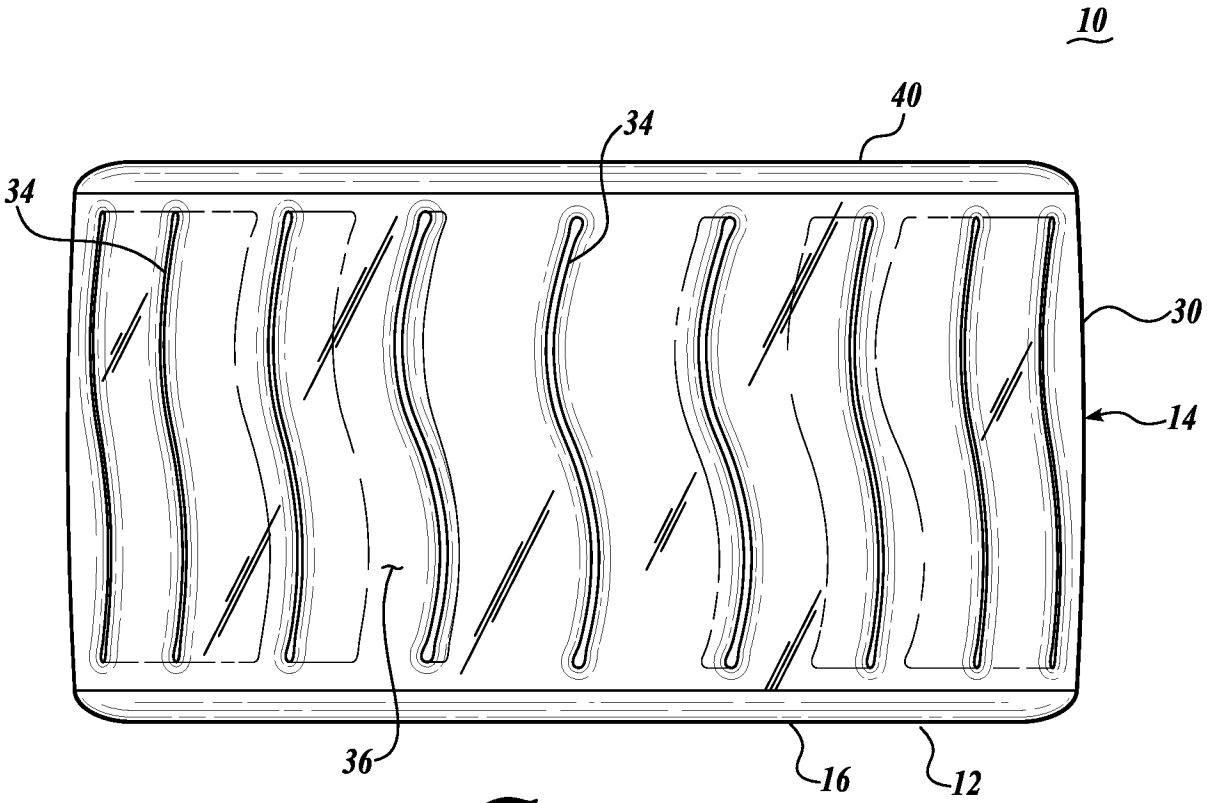
FIG. 4 is an end elevation view of FIG. 1.
Figure 5:
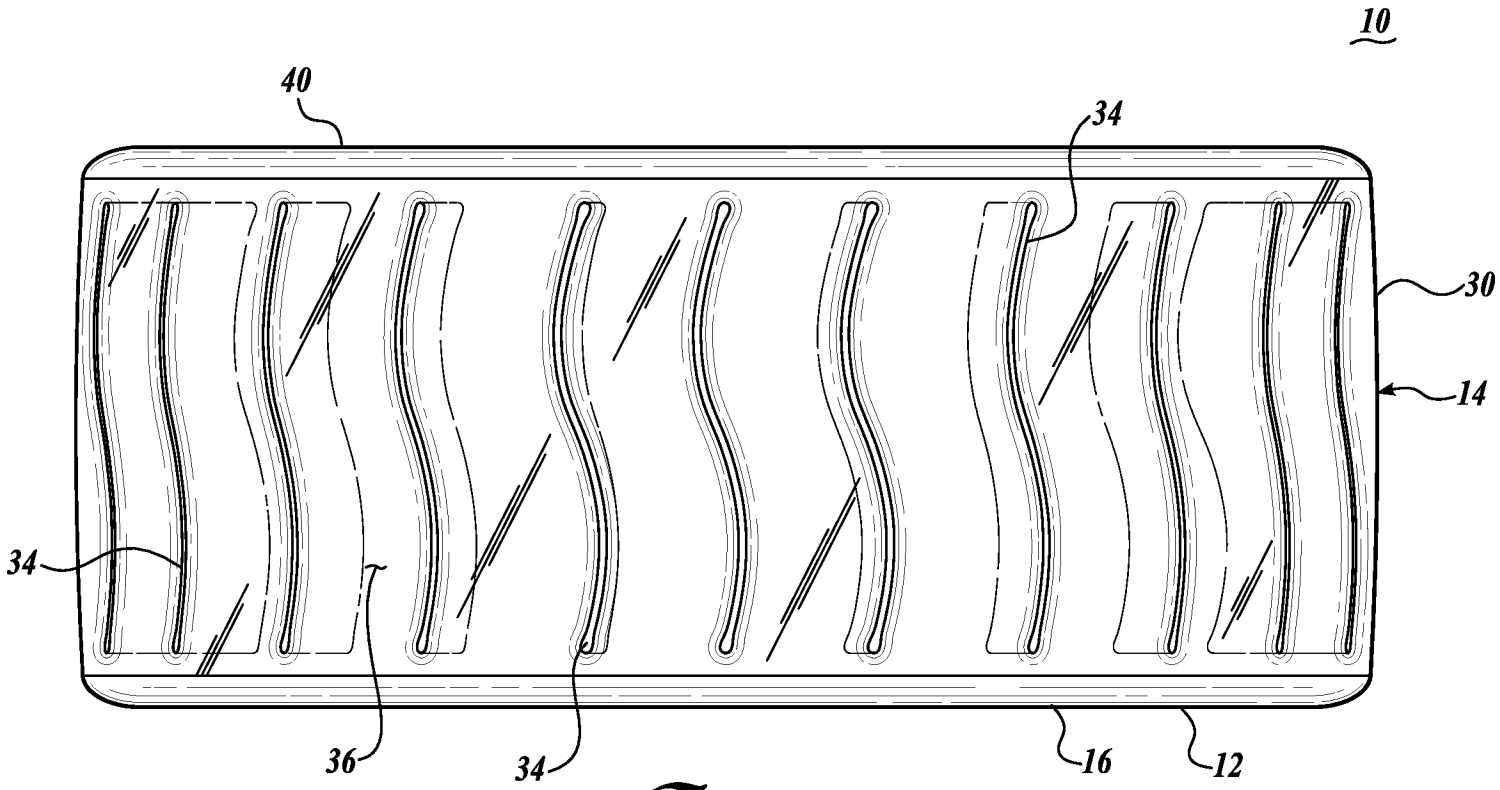
FIG. 5 is a side elevation view of FIG. 1.

Likewise, as shown in FIG. 3, the lower edge 42 of the wall 14 is rounded in a manner similar to upper edge 40, to also present a smooth transition from the lower edges of the inner and outer layers 32 and 30 of wall 14. The lower edges of the inner and outer layers 32 and 30 can be heat fused and/or glued or otherwise attached to the inner and outer perimeter of the wall lower edge 42. Further the outer perimeter of the floor section 12 is heat fused and/or glued to the inner perimeter of the wall lower edge 42, thereby to prevent water from leaking or otherwise escaping between the floor section 12 and the bottom of the perimeter wall 14.

Referring to FIG. 1, handles 50 are mounted on the inner layer 32 of the perimeter wall 14. The handles can be positioned at various locations within the birthing pool, for example, centrally along the length of the pool at opposite sides thereof. Other possible locations include within convenient reach of the person within the pool. The handles include a base section 54 which can be positioned face-to-face with the inner layer 32 of the perimeter wall 14. A U-shaped hand grip 52 is positioned outwardly from the base section to be conveniently grasped by the pool occupant.

Figure 6:
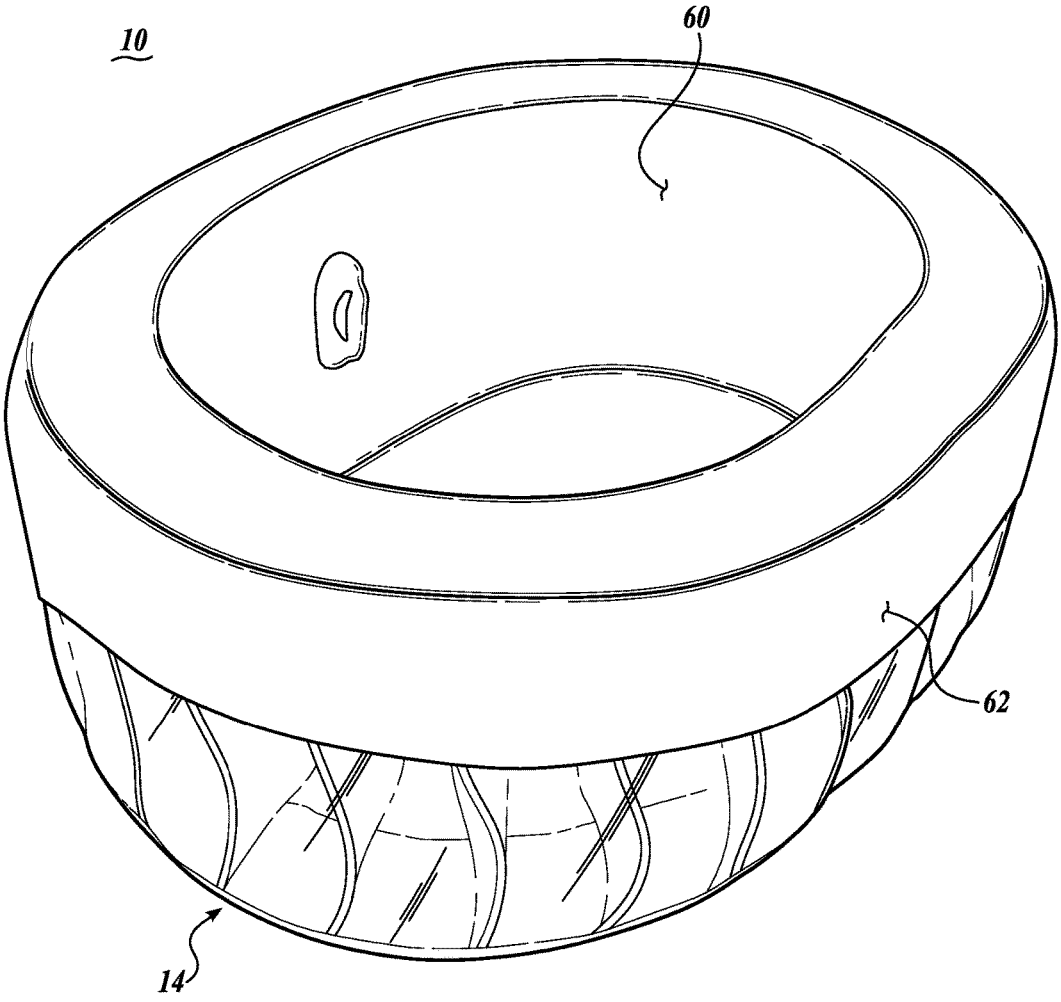
FIG. 6 is an isometric view similar to FIG. 1 with the inclusion of a liner.

Referring to FIG. 6, a liner 60 can be used in conjunction with the pool 10. The liner can be constructed in a shape that corresponds to the interior shape of the pool 10 so that when the liner is inserted within the pool, the liner closely overlays the floor section 12 and the interior of the perimeter wall 14. The liner 60 includes a marginal section 62 that extends over the upper edge 40 of the pool and then downwardly to overlie the exterior layer 30 of the pool. In one embodiment to the present disclosure, the marginal section 62 snugly overlies the exterior of the pool so that the liner does not tend to shift, but remains in place during usage of the pool. In this regard, the liner can be positioned within the pool while the pool is being inflated so that when the pool is fully inflated, the marginal section 62 of the liner is tightly engaged over the exterior of the perimeter wall 14.

The liner can be constructed of any appropriate material, such as a PVC or similar composition. Also, the thickness or strength of the liner need not necessarily be equivalent to that of the pool per se, which is described below.

Figure 7:
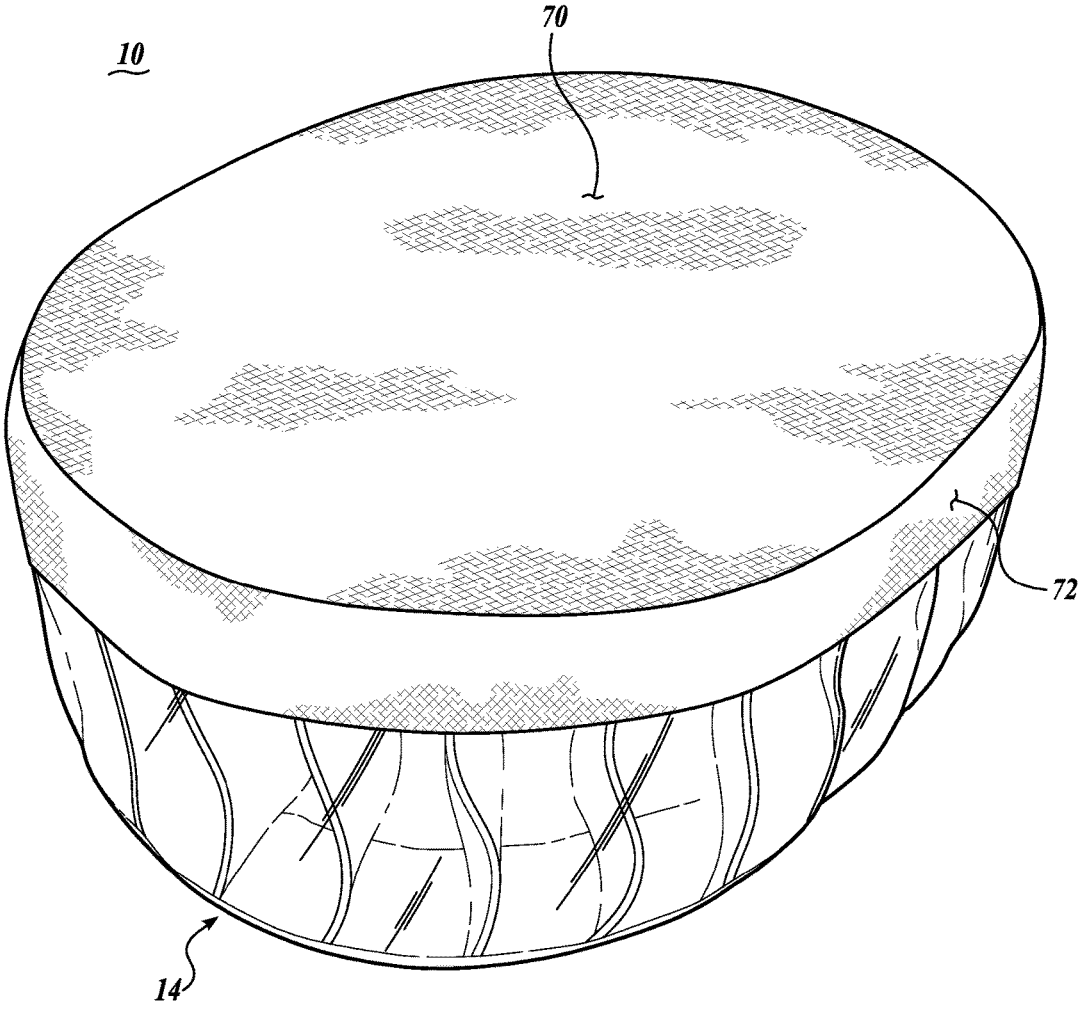
FIG. 7 is an isometric view similar to FIG. 1 with the inclusion of a cover.

Referring to FIG. 7, the pool 10 may be fitted with a cover 70, which fits over the open top of the pool to close off the pool. The cover matches the shape of the pool when viewed from the top. The cover helps retain the heat within the pool and keeps objects from falling into the pool. The cover 70 is designed to closely overlap the upper marginal section of the exterior of the pool. In this regard, the pool cover 70 includes a hem or marginal section 72 that extends downwardly to overlap the outer layer 30 of the perimeter wall.

The pool cover 70 may be textured to improve strength and also to make the cover more supple and easier to manage. This texture can also help prevent the cover from slipping relative to the upper edge 40 of the pool. The pool cover can be made from a suitable material, such as a PVC or similar composition. Moreover, the cover can be relatively thin, for example, having a thickness from about 0.12 to 0.24 mm. The pool 10, including the floor section 12 and perimeter wall 14, can be made from numerous materials, for example, the pool 10 can be composed of a PVC having a thickness of from about 0.40 to 0.52 mm. Moreover, the material used to construct the pool can be K80 PVC. This material in this thickness range results in a substantially tough and durable construction, similar to that used to manufacture inflatable rafts and other types of rugged and durable watercraft, such as inflatable canoes and kayaks. One brand of K80 PVC is sold under the trade name PolyKrylar. Another suitable material for the construction of the birthing pool is Hypalon (SCM).

The birthing pool 10 is shown in the figures as being generally ovoid in shape having rounded ends and parallel longitudinal sides. In one example, in overall size the birthing pool may be approximately 66 inches long and 54 inches wide and about 28 inches high. Further, the thickness of the floor section may be about 3 inches, and the thickness of the wall section can be about 7 to 9 inches. In this size, the birthing pool 10 is designed to be filled with about 115 gallons of water.

It will be appreciated that the birthing pool 10 can be of other shapes, including a true oval shape wherein the sides of the pool are not parallel but are curved to form part of the oval. As an alternative, the birthing pool may be round in shape. However, a round pool requires more floor area than ovoid-shaped pools. As a further alternative, the birthing pool may be pear shaped having one end with a larger radius or curvature than in the opposite end. Other shapes for the birthing pool are possible.

In profile, the birthing pool can be constructed so that the perimeter walls 14 are substantially vertical. However, other profiles for the perimeter wall are possible. For example, the perimeter walls can be constructed so that the walls extend somewhat outwardly in the upward direction so that at the top of the pool (in plan view), the interior of the pool is somewhat larger than at the elevation of the floor section 12.

As a further alternative, the birthing pool can be constructed so that the perimeter wall in elevation is outwardly convex.

While illustrative embodiments have been illustrated and described, it will be appreciated that various changes can be made therein without departing from the spirit and scope of the invention.

The embodiments of the invention in which an exclusive property or privilege is claimed are defined as follows:

1. An inflatable birthing pool, comprising:

(a) an inflatable substantially hollow floor section comprising a bottom layer and a top layer spaced a distance above the bottom layer when the floor section is inflated, said floor section further comprising a plurality of floor beams extending edgewise between the top and bottom layers to divide the floor section into a plurality of floor chambers when the floor section is inflated, the plurality of floor beams having a width corresponding to the distance that the top layer is spaced above the bottom layer:

(b) an inflatable substantially hollow perimeter wall extending upwardly from the perimeter of the floor section to define a top, the perimeter wall comprising an outer layer and an inner layer spaced inwardly from the outer layer when the perimeter wall is inflated, said perimeter wall further comprising a plurality of upright wall beams extending between the outer layer and the inner layer of the perimeter wall to divide the perimeter wall into a series of upright chambers, each of the wall beams defining:

an upper end and a lower end defining a length between the upper end and lower end;

and a first side edge and a second side edge;

the first side edge attached to the outer layer along the length including at the upper end and lower end, the second side edge attached to the inner layer along the length including at the upper end and lower end; and wherein a cross section of the beam taken along the length direction is serpentine in profile.

2. The birthing pool according to claim 1, wherein the plurality of floor section beams extend along the floor section but stop short of the perimeter of the floor section to define a fluid passage between adjacent floor chambers.

3. The birthing pool according to claim 1, wherein the plurality of floor beams are straight along their lengths.

4. The birthing pool according to claim 1, wherein the plurality of floor beams each have a first side edge attached to the top layer of the floor section and a second side edge attached to the bottom layer of the floor section.

5. The birthing pool according to claim 1:

wherein the perimeter wall has a bottom; and wherein each wall beam stops short of the bottom and top of the perimeter wall to define a fluid passageway between adjacent upright chambers.

6. The birthing pool according to claim 1, further comprising a rounded upper edge defining the top of the perimeter wall.

7. The birthing pool according to claim 1, wherein the perimeter wall in the upright direction from the floor section defines an outwardly convex shape.

8. The birthing pool according to claim 1, wherein the floor section is isolated from the perimeter wall with respect to any fluid flow between the floor section and the perimeter wall.

9. The birthing pool according to claim 1, further comprising a liner insertable into the interior of the birthing pool and extending over the top of the perimeter wall and down the exterior of the perimeter wall.

10. The birthing pool according to claim 9, wherein the liner overlies the exterior of the birthing pool.

11. The birthing pool according to claim 1, further comprising a cover positionable over the birthing pool, said cover having a skirt section that extends downwardly from the top of the perimeter wall to overlap the outer layer of the perimeter wall.

12. The birthing pool according to claim 1, wherein the bottom and top layers of the birthing pool floor section are composed of 0.46 mm K80 PVC.

13. The birthing pool according to claim 12, wherein the plurality of floor beams are composed of 0.46 mm K80 PVC.

14. The birthing pool according to claim 13, wherein the outer layer and inner layer of the perimeter wall are composed of 0.46 mm K80 PVC.

15. The birthing pool according to claim 14, wherein the plurality wall beams are composed of 0.46 mm K80 PVC.

16. The birthing pool according to claim 13, wherein the birthing pool is ovoid in shape.

17. The birthing pool according to claim 16, wherein the birthing pool has a length from 66 to 70 inches, a width from 50 to 58 inches, and a height from 26 to 30 inches.

* * * * *

UNITED STATES PATENT AND TRADEMARK OFFICE

CERTIFICATE OF CORRECTION

PATENT NO. : 10,392,822 B2
APPLICATION NO. : 15/824866
DATED : August 27, 2019
INVENTOR(S) : D. N. Thorpe It is certified that error appears in the above-identified patent and that said Letters Patent is hereby corrected as shown below:

In the Claims

| Column | Line | Error |
|---|---|---|
| 8 (Claim 14, Line 1) | 18 | "claim 13" should read --claim 1-- |
| 8 (Claim 15, Line 2) | 23 | "plurality" should read --plurality of-- |
| 8 (Claim 16, Line 1) | 24 | "claim 13" should read --claim 1-- |

Signed and Sealed this
Fourth Day of February, 2020

Andrei Iancu

Andrei Iancu
*Director of the United States Patent and Trademark Office*